US011701556B2

(12) United States Patent
Munson et al.

(10) Patent No.: US 11,701,556 B2
(45) Date of Patent: Jul. 18, 2023

(54) GOLF CLUB HEAD WITH EXTERNAL AND INTERNAL RIBS

(71) Applicant: SUMITOMO RUBBER INDUSTRIES, LTD., Kobe (JP)

(72) Inventors: Anthony Munson, Huntington Beach, CA (US); Joseph Chen, Costa Mesa, CA (US); Alexandra Agrella, Vista, CA (US)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

(21) Appl. No.: 16/460,114

(22) Filed: Jul. 2, 2019

(65) Prior Publication Data

US 2021/0001187 A1 Jan. 7, 2021

(51) Int. Cl.
*A63B 53/04* (2015.01)

(52) U.S. Cl.
CPC ..... *A63B 53/0466* (2013.01); *A63B 53/045* (2020.08); *A63B 53/0412* (2020.08); *A63B 53/0437* (2020.08)

(58) Field of Classification Search
CPC ..... A63B 53/0466; A63B 2053/0412; A63B 2053/0437; A63B 2053/045; A63B 53/045; A63B 53/0412; A63B 53/0437; A63B 53/0408; A63B 53/04; A63B 60/002; A63B 60/52
USPC ..... 473/346
See application file for complete search history.

(56) References Cited

U.S. PATENT DOCUMENTS

| | | | | |
|---|---|---|---|---|
| 5,989,134 | A * | 11/1999 | Antonious | A63B 53/04 473/327 |
| 6,146,287 | A | 11/2000 | Rugge et al. | |
| 6,319,148 | B1 * | 11/2001 | Tom | A63B 53/00 473/290 |
| 6,645,087 | B2 | 11/2003 | Yabu | |
| 6,773,359 | B1 | 8/2004 | Lee | |
| 7,563,177 | B2 | 7/2009 | Jertson et al. | |
| 7,670,234 | B1 | 3/2010 | Kellerman | |
| 7,854,666 | B2 * | 12/2010 | Horacek | A63B 53/04 473/332 |
| 8,206,242 | B2 | 6/2012 | Jertson et al. | |
| 8,360,900 | B2 | 1/2013 | Snyder | |
| 8,608,587 | B2 | 12/2013 | Henrikson et al. | |
| 8,753,224 | B1 | 6/2014 | Kim | |
| 8,777,773 | B2 | 7/2014 | Burnett et al. | |
| 9,168,432 | B2 | 10/2015 | Henrikson et al. | |
| 9,555,294 | B2 | 1/2017 | Henrikson et al. | |
| 9,649,543 | B2 | 5/2017 | Solheim et al. | |
| 9,694,254 | B2 | 7/2017 | Ashino | |

(Continued)

*Primary Examiner* — Michael D Dennis
(74) *Attorney, Agent, or Firm* — Oliff PLC

(57) ABSTRACT

A hollow-type golf club head, when oriented in a reference position, includes: a striking wall; a sole portion; a top portion having an exterior surface and an interior surface; a hosel extending from the top portion and defining a hosel axis; and a plurality of external ribs located on the exterior surface of the top portion. The plurality of external ribs are each generally elongate in a front-to-rear direction, and at least one internal rib is located on the interior surface of the top portion and is generally elongate in the front-to-rear direction. The at least one internal rib is spaced from the plurality of external ribs by a distance D1 no less than 2 mm as considered in top view of the club head.

9 Claims, 4 Drawing Sheets

(56) References Cited

U.S. PATENT DOCUMENTS

| | | | | |
|---|---|---|---|---|
| 9,724,573 | B2 | 8/2017 | Kawaguchi et al. | |
| 9,776,053 | B2 | 10/2017 | Burnett et al. | |
| 9,925,430 | B2 | 3/2018 | Stokke et al. | |
| 10,188,914 | B2 | 1/2019 | Narita et al. | |
| 2003/0104878 | A1* | 6/2003 | Yabu | A63B 60/00 473/345 |
| 2005/0221913 | A1* | 10/2005 | Kusumoto | A63B 53/0466 473/345 |
| 2008/0051219 | A1* | 2/2008 | Erickson | A63B 53/0466 473/349 |
| 2008/0248895 | A1* | 10/2008 | Tavares | B29C 70/68 473/345 |
| 2009/0286611 | A1* | 11/2009 | Beach | A63B 53/06 473/335 |
| 2009/0305814 | A1* | 12/2009 | Jertson | A63B 53/0466 473/409 |
| 2010/0304888 | A1* | 12/2010 | Hirano | A63B 53/0466 473/342 |
| 2013/0109503 | A1* | 5/2013 | Matsunaga | A63B 60/00 473/346 |
| 2013/0130833 | A1* | 5/2013 | Ban | A63B 53/0466 473/345 |
| 2014/0031139 | A1* | 1/2014 | Johnson | A63B 53/0466 473/307 |
| 2016/0213985 | A1* | 7/2016 | Jertson | A63B 53/0466 |
| 2016/0332042 | A1* | 11/2016 | Takechi | A63B 60/52 |
| 2017/0021239 | A1* | 1/2017 | Stokke | A63B 53/06 |
| 2017/0333767 | A1* | 11/2017 | Cole | A63B 53/0466 |

* cited by examiner

GOLF CLUB HEAD WITH EXTERNAL AND INTERNAL RIBS

BACKGROUND

This disclosure relates generally to the field of golf clubs. More particularly, it relates to a hollow-type golf club head with external and internal ribs.

Driving is often considered to be one of the most difficult aspects of golf. Because of the length associated with a drive, relatively minor deviations in striking face orientation at impact can have a substantial impact on the effectiveness of the shot, e.g., whether it is in the fairway, rough, or even out of bounds.

SUMMARY

It has therefore been a goal of club head manufacturers to reduce the tendency of the club head to change orientation, or twist, during impact. One effective way by which to do so is to relocate discretionary, i.e., non-structural, mass so as to increase the club head's moment of inertia ("MOI"), or in layman's terms increase the club head's resistance to such twisting. MOI about a vertical axis through the club head's center of gravity ("Izz") is the most important in this endeavor. But the club head's MOI about a horizontal axis in the heel-to-toe direction through the center of gravity ("Iyy") should also be considered. As should its MOI about a horizontal axis in the front-to-rear direction through the center of gravity ("Ixx").

Because the driver is intended to be the longest club in a golfer's bag, it is also often another goal of manufacturers to increase the distance at which a ball struck by the driver will travel. One manner by which to do so is to lower the club head's center of gravity. This may increase dynamic loft, i.e., the loft of the club head delivered at impact, as well reduce spin, thereby potentially resulting in greater ball flight for certain golfers.

A hollow-type golf club head according to one or more aspects of the present disclosure may thus, when oriented in a reference position, comprise: a striking wall; a sole portion; a top portion having an exterior surface and an interior surface; a hosel extending from the top portion and defining a hosel axis; a plurality of external ribs located on the exterior surface of the top portion, the plurality of external ribs each being generally elongate in a front-to-rear direction; and at least one internal rib located on the interior surface of the top portion and being generally elongate in the front-to-rear direction. The at least one internal rib may be spaced from the plurality of external ribs by a distance D1 no less than 2 mm as considered in top view of the club head.

A hollow-type golf club head in accordance with one or more aspects of the present disclosure may also, when oriented in a reference position, comprise: a striking wall; a sole portion; a top portion having an exterior surface and an interior surface; a hosel extending from the top portion and defining a hosel axis; a plurality of external ribs located on the exterior surface of the top portion, the plurality of external ribs each being generally elongate in a front-to-rear direction and spaced apart from each other by a distance D2 that is no less than 8 mm; and at least one internal rib located on the interior surface of the top portion and being generally elongate in the front-to-rear direction.

These and other features and advantages of the golf club head according to the various aspects of the present disclosure will become more apparent upon consideration of the following description, drawings, and appended claims. The description and drawings described below are for illustrative purposes only and are not intended to limit the scope of the present invention in any manner. It is also to be understood that, for the purposes of this application, any disclosed range encompasses a disclosure of each and every sub-range thereof. For example, the range of 1-5 encompasses a disclosure of at least 1-2, 1-3, 1-4, 1-5, 2-3, 2-4, 2-5, 3-4, 3-5, and 4-5. Further, the end points of any disclosed range encompass a disclosure of those exact end points as well as of values at approximately or at about those endpoints.

BRIEF DESCRIPTION OF THE DRAWINGS

Exemplary embodiments of the present disclosure will now be described with reference to the accompanying drawings.

DETAILED DESCRIPTION OF EMBODIMENTS

Figure 1:
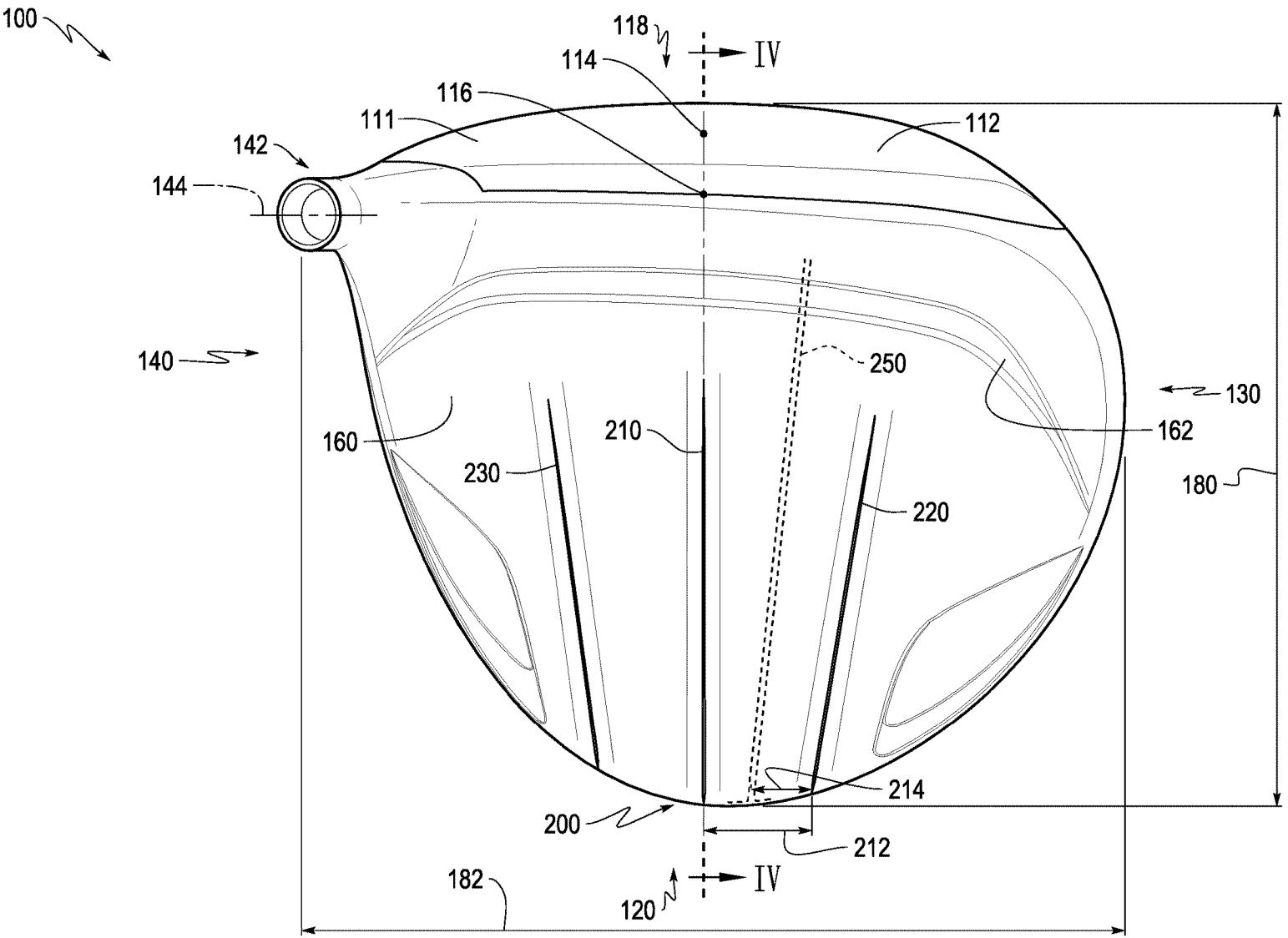
FIG. 1 shows a top plan view of a golf club head in accordance with one or more exemplary embodiments.

Shown in FIG. 1 is a golf club head 100 according to one or more aspects of the present disclosure. The club head 100 may be a hollow-type club head. For example, as shown in FIG. 1, it may be a wood-type club head, and even more specifically, it may be a driver. The club head 100 may generally be formed from metallic and/or nonmetallic materials, such as any one or a combination of aluminum, stainless steel, titanium, composites, polymeric materials, and any other suitable material.

Unless otherwise stated, all golf club head embodiments shown and described herein are assumed to be oriented in a reference position and all aspects of such embodiments are described relative to such reference position. The term "reference position," as used herein, denotes a club head position wherein a hosel has a hosel axis that is oriented at a lie angle $\alpha$ of 60° with respect to a horizontal virtual ground plane and lies in an imaginary vertical virtual hosel plane, which contains a virtual horizontal line parallel to the striking face.

The club head 100 may include a front portion 110, which has a striking wall 111 including a striking face 112 for contacting a golf ball, and a rear portion 120. The striking face 112 may include a face center 114, which is the point on the striking face 112 that is equidistant from the striking face periphery in both the horizontal direction and in the vertical direction, as set out in the United States Golf Association's Procedure for Measuring the Flexibility of a Golf Club Head (Revision 2.0, Mar. 25, 2005), in which "face center" is described as identifiable using a designated template for such purpose. Directly above the face center 114 and coincident with the striking face periphery proximate the top portion of the club head, the striking face 112 may also include a central apex 116. The club head 100 may further include a toe portion 130, a heel portion 140, a sole portion 150, and a top portion, or crown, 160. The heel portion 140 may include a hosel 142 configured to receive and secure a shaft (not shown) of the golf club. The hosel 142 may have a hosel axis 144. And the club head 100 may also include a center of gravity at a location 170, which will be discussed in greater detail in the following.

Figure 2:
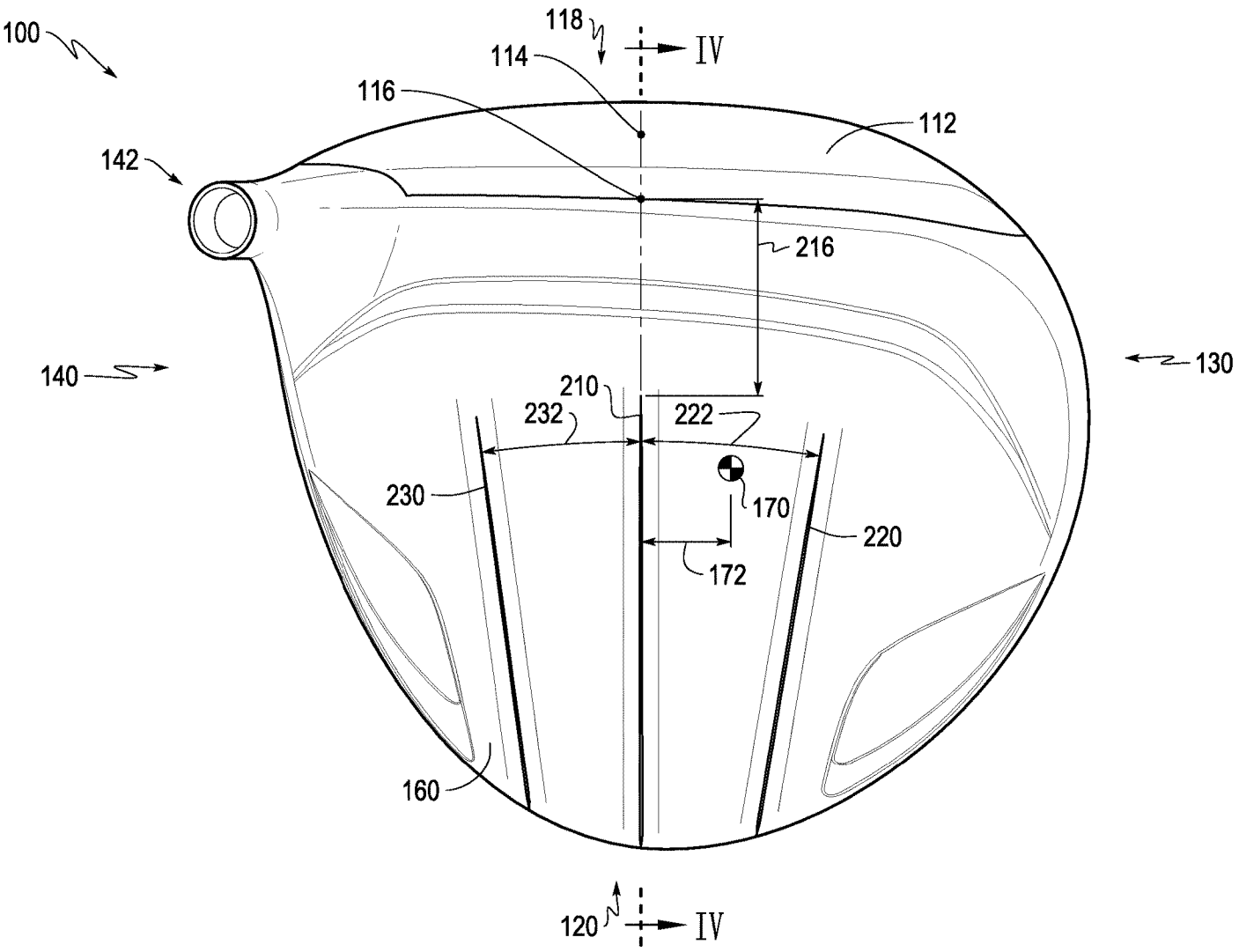
FIG. 2 shows another top plan view of the golf club head of FIG. 1.
Figure 3:
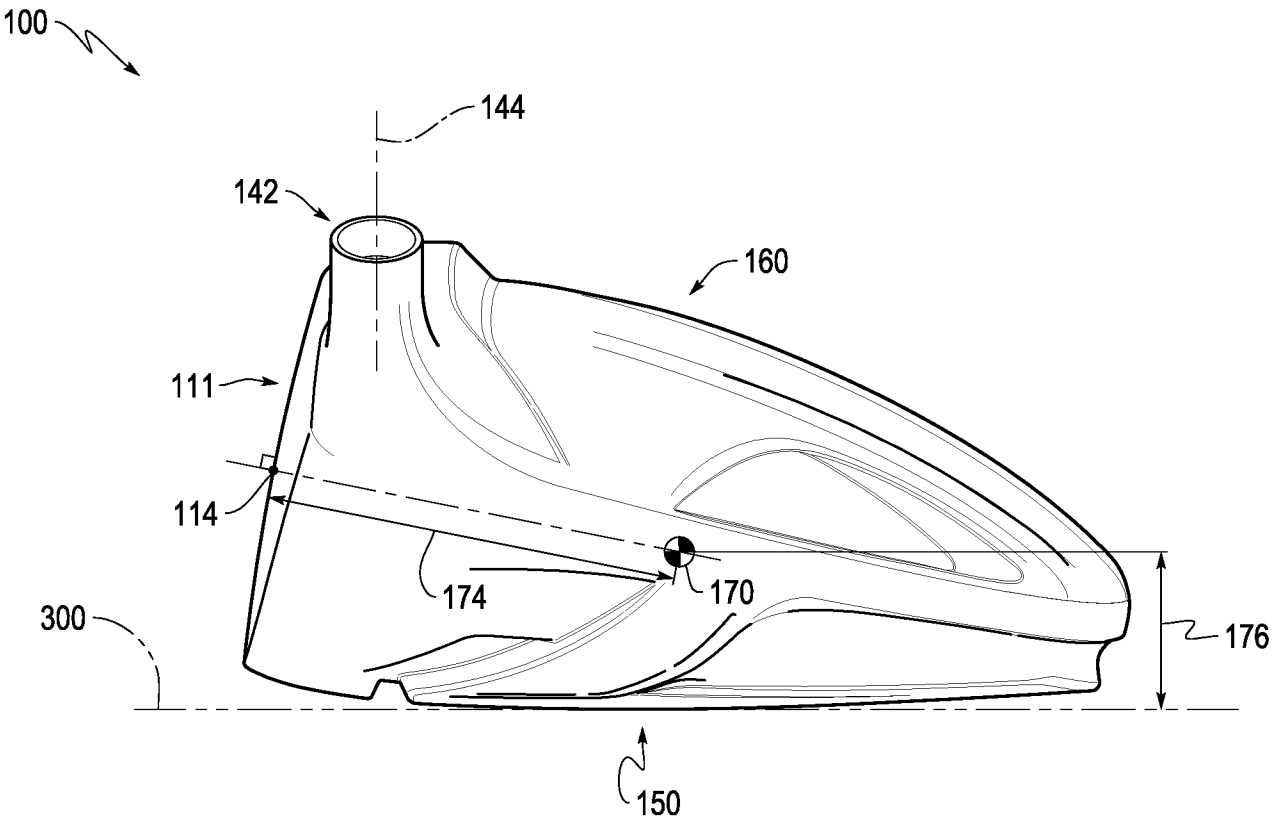
FIG. 3 shows a heel-side view of the golf club head of FIG. 1.

Returning to FIGS. 1 and 2, the top portion 160 may also include a step-down portion 162, in which the crown moves closer to the sole portion 150. This step-down portion 162 moves mass toward the sole portion 150 and increases structural integrity of the top portion 160 without significantly adding mass. As shown in FIG. 3, the contour of the top portion 160 may generally match that of the sole portion 150. For example, the contours of both the top portion and the sole portion preferably have a high degree of visual symmetry and, as a result, mass symmetry. In addition to forming an integrated pattern that is visually pleasing, this matching contour has various benefits. For example, similar air flow characteristics above and below the club head 100 may result in greater stability and rigidity of the club head through impact with the golf ball. Also, at impact, vibrations emanating from structures having a high degree of symmetry are believed to have greater consistency, resulting in crisper sound and feel. This degree of symmetry may be quantified in part by considering the full moment of inertia matrix corresponding to the club head's center of gravity. For all purposes herein, x-, y-, and z-directions correspond to a virtual Cartesian coordinate system having its origin coincident with the center of gravity of the club head such that: an x-axis extends in the front-to-rear direction, a y-axis extends in the heel-to-toe direction, and a z-axis extends vertically. Given this environment, the club head may be considered to have moments of inertia Ixx, Iyy, and Izz, corresponding to moments of inertia about respective axes x, y, and z. However, the club head may also be considered to exhibit a conventional Inertia matrix which further includes products of inertia Ixy, Iyx, Ixz, Izx, Iyz, and Izy. These products of inertia are to a degree indicative of the mass symmetry about the plane to which they correspond. Thus, in accordance with the above, Ixy may be no greater than 540 $g*cm^2$ and more preferably no greater than 500 $g*cm^2$. The top portion 160 may also include at least one decal to add texture. Decals are often easier to apply than paint, where a reveal or recess in the club head exterior would be required for the paint.

The top portion 160 may yet also include at least one external rib 200 on its exterior surface. For example, it may include a central external rib 210, a toe-side external rib 220, and a heel-side external rib 230. The top portion 160 also may include at least one internal rib on its interior surface. One such internal rib 250 is shown by way of phantom in FIG. 1 and in the cross-section of FIG. 4, which is taken along a virtual vertical plane IV that extends in the front-to-rear direction and intersects the face center 114 and the central external rib 210. There may be more internal ribs, however. As shown in FIGS. 1 and 2, the central external rib 210 may extend in a direction parallel to the front-to-rear direction of the club head, but the ribs 220 and 230 may converge in that front-to-rear direction, preferably at a point rearward of the club head 100. The angles 222 and 232 at which the ribs 220 and 230 may respectively converge relative to the front-to-rear direction may each be 15°, for example. Moving mass of the club head 100 rearward in this manner beneficially raises Izz, though it may also result in a decrease in Ixx, as mass is primarily relocated more centrally.

The ribs 210, 220, and 230 may be spaced from each other by a distance 212, or "D2." This distance 212 may be no less than 8 mm, more preferably no less than 10 mm, even more preferably between 10 mm and 20 mm, and most preferably between 12 mm and 18 mm. This distance 212 is preferred so as to help prevent "ghosting" issues arising from formation of the internal rib 250. This "ghosting" is slight deformation in the wall of the top portion 160 that is visible due to curing of the internal rib 250 during manufacture of the club head. To prevent this "ghosting," a reduced-width polishing belt is fit between the ribs 210, 220, and 230 to polish away the deformation in the wall caused by the curing of the internal rib 250. Because the width of the polishing belt cannot be less than 5 mm to 6 mm as a practical matter, the above values of the distance 212 ensure that the belt width is commensurate with the minimum spacing between the exterior ribs 210, 220, and 230.

Figure 4:
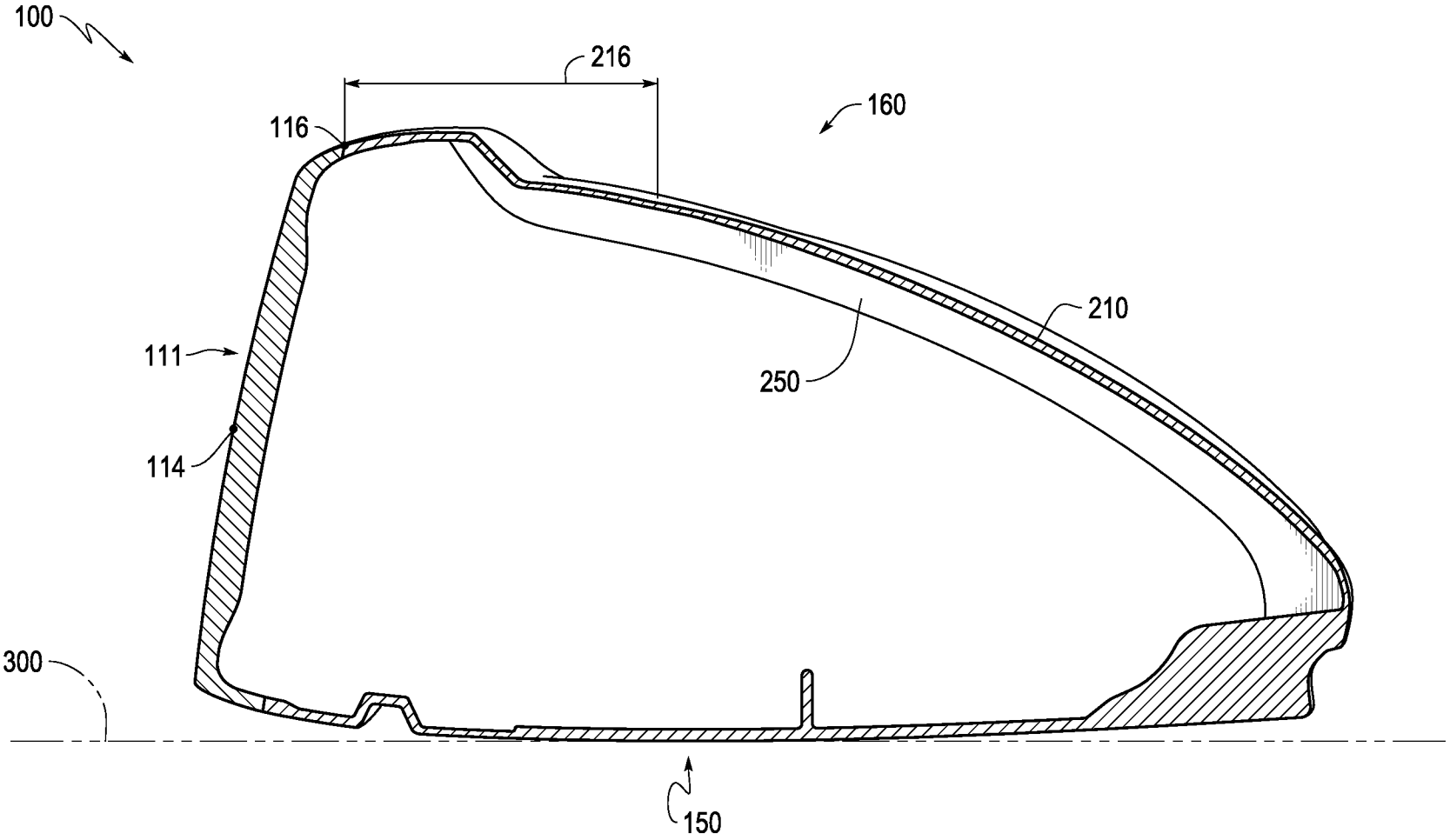
FIG. 4 shows a cross-section view of the golf club head of FIG. 1.

As shown in FIGS. 2 and 4, the exterior ribs 200, and particularly the central exterior rib 210, may be spaced from the central apex 116 of the striking face 112 by a distance 216, or "D3." This distance 216 may preferably be no less than 10 mm, more preferably no less than 20 mm, and even more preferably, it may be between 25 mm and 45 mm. This distance 216 between the exterior ribs 200 and the central apex 116 moves the exterior ribs rearward, thereby adding structural rigidity primarily to the rear portion 120. Moving the exterior ribs 200 rearward by the distance 216 also moves the mass of the club head 100 rearward, thereby increasing Izz.

The internal rib 250, which is primarily included to alter the sound of the club head at impact with the golf ball, may preferably be spaced from the external ribs 210, 220, and 230 in the heel-to-toe direction by a distance 214, or "D1." This offset allows the aforementioned polishing to remove the "ghosting" caused during formation of the internal rib 250. The distance 214 may preferably be no less than 2 mm, more preferably between 2 mm and 8 mm, and even more preferably between 4 mm and 6 mm. Although it is possible to manufacture the club head 100 so that the internal and external ribs are not offset, this is not preferred. Doing so may lead to complications, in which the shape of the top portion 160 must be designed to factor in the shrinkage of the external ribs 210, 220, and 230. The internal rib 250 may also be longer in length that the external ribs 200. As shown in FIG. 4, this rib 250 may extend from the top portion 160 to the sole portion 150. And it may extend in the front-to-rear direction almost to the interface of the top portion 160 and the striking wall 111.

Large drivers typically have increased MOI, but they may not be well-received by golfers. Larger size also increases complexity of vibratory wave emanation upon impact, which may require more complex stiffening structure, thus reducing discretionary mass and deleteriously affecting "feel" of the club head. The volume of the club head 100 may thus be greater than 360 cc, more preferably between 375 cc and 470 cc, and more preferably under 460 cc. Even more preferably, the club head 100 may be relatively compact, say between 400 cc and 445 cc, and most preferably between 430 cc and 445 cc. Its mass may preferably be between 175 g and 210 g, more preferably between 185 g and 205 g, even more preferably between 190 g and 200 g, and most preferably under 200 g. The depth 180 of the club head 100, spanning from a forward-most extent to a rearward-most extent of the club head, may be less than 5.0 in., more preferably between 4.5 in. and 4.75 in., and even more preferably between 4.5 in. and 4.65 in. The width 182 of the club head 100, spanning from the heel-most extent to the toe-most extent of the club head, may likewise be less than 5.0 in., more preferably between 4.75 in. and 5.0 in., and even more preferably between 4.9 in. and 5.0 in. Preferably, the width 182 of the club head 100 may be greater than its depth 180 so that a ratio of the depth 180 to the width 182 is no greater than 0.94, more preferably between 0.90 and 0.94, and even more preferably between 0.93 and 0.94.

Despite its relatively compact shape, the golf club head 100 may nonetheless achieve a relatively high MOI, especially Izz. It may do so in part by moving mass from the side of the heel portion 140 to shift, as shown in FIG. 2, the center of gravity 170 of the club head 100 toe-ward of the face center 114 by a distance 172, or "D5." This distance 172 may be at least 0.5 mm, more preferably at least 1 mm, and even more preferably at least 1.25 mm. The increased discretionary weight allowed by virtue of the relatively compact size of the club head 100 may also allow the center of gravity 170 to be located deeper into the club head and closer to the sole portion 150 than otherwise possible. For example, the depth 174, or "D4," of the center of gravity 170 in a direction rearward of and perpendicular to the striking wall 111 may be less than 30 mm, more preferably no less than 35 mm, even more preferably between 35 mm and 50 mm, and even more preferably between 40 mm and 50 mm. Relative to the club head depth 180, the depth 174 may be at least 30% of the depth 180, more preferably at least 35% of the depth 180, and even more preferably between 35% and 40% of the depth 180. And the height 176 of the center of gravity 170 relative to the lowermost point of the sole portion 150 in contact with a virtual ground plane 300 may be less than 30 mm, more preferably less than 28 mm, even more preferably between 22 mm and 28 mm, and most preferably equal to or about 26 mm. While Izz of the club head 100 may not in and of itself approach new heights, this placement of the center of gravity 170 ensures that it is greater than it would be otherwise, especially for the compact size of the club head 100. Izz may thus be no less than 4600 $g*cm^2$ and more preferably no less than 4800 $g*cm^2$.

In the foregoing discussion, the present invention has been described with reference to specific exemplary aspects thereof. However, it will be evident that various modifications and changes may be made to these exemplary aspects without departing from the broader spirit and scope of the invention. Accordingly, the foregoing discussion and the accompanying drawings are to be regarded as merely illustrative of the present invention rather than as limiting its scope in any manner.

What is claimed is:

1. A hollow-type golf club head that, when oriented in a reference position, comprises:

a striking wall having a striking face configured to impact a golf ball, the striking face including a face center and a central apex;

a sole portion;

a top portion having an exterior surface, an interior surface, and a step-down portion in which a crown of the club head moves toward the sole portion;

a hosel extending from the top portion and defining a hosel axis;

a plurality of external ribs located on the exterior surface of the top portion, the plurality of external ribs: (i) each being generally elongate in a front-to-rear direction, (ii) spaced apart from each other by a distance D2 that is between 10 mm and 20 mm, (iii) spaced rearwardly from the central apex by a distance D3 between 25 mm and 45 mm, and (iv) including:

a first external rib;

a second external rib located toe-ward of the first external rib; and a third external rib located heel-ward of the first external rib; and at least one internal rib (i) located on the interior surface of the top portion, (ii) generally elongate in the front-to-rear direction, (iii) longer in length than the plurality of external ribs, and (iv) when viewed in a top view, located between the first external rib and the second external rib and entirely spaced from the first external rib and the second external rib by a distance of at least 2 mm.

2. The golf club head of claim 1, wherein the plurality of external ribs converge in the rearward direction.

3. The golf club head of claim 1, further comprising a moment of inertia Izz about a virtual vertical axis passing through the center of gravity, Izz being no less than 4600 $g*cm^2$.

4. The golf club head of claim 1, further comprising a club head depth and the center of gravity having a center of gravity depth D4, measured rearward of and perpendicular to the striking wall, that is no less than 30% of the club head depth.

5. The golf club head of claim 1, further comprising a volume no less than 360cc.

6. The golf club head of claim 1, wherein the distance D2 is between 12 mm and 18 mm.

7. The golf club head of claim 1, wherein a center of gravity of the club head is located toe-ward of the face center.

8. The golf club head of claim 1, wherein the at least one internal rib extends closer to the striking face than does the step-down portion.

9. The golf club head of claim 1, wherein the at least one internal rib is entirely spaced from the first external rib and the second external rib by a distance between 4 mm and 6 mm.

* * * * *